US011844481B2

(12) United States Patent
Welling et al.

(10) Patent No.: US 11,844,481 B2
(45) Date of Patent: Dec. 19, 2023

(54) INTEGRATED DISHWASHER SINK APPARATUS

(71) Applicants: William Welling, Puyallup, WA (US); Daphanie Welling, Puyallup, WA (US)

(72) Inventors: William Welling, Puyallup, WA (US); Daphanie Welling, Puyallup, WA (US)

( * ) Notice: Subject to any disclaimer, the term of this patent is extended or adjusted under 35 U.S.C. 154(b) by 487 days.

(21) Appl. No.: 17/171,086

(22) Filed: Feb. 9, 2021

(65) Prior Publication Data

US 2022/0248934 A1 Aug. 11, 2022

(51) Int. Cl.

| | |
|---|---|
| ***A47L 15/00*** | (2006.01) |
| ***A47L 15/42*** | (2006.01) |
| ***A47L 15/50*** | (2006.01) |
| ***E03C 1/182*** | (2006.01) |

(52) U.S. Cl.

CPC ..... *A47L 15/0086* (2013.01); *A47L 15/4293* (2013.01); *A47L 15/4295* (2013.01); *A47L 15/501* (2013.01); *A47L 15/507* (2013.01); *E03C 1/182* (2013.01)

(58) Field of Classification Search

None

See application file for complete search history.

(56) References Cited

U.S. PATENT DOCUMENTS

| | | | | |
|---|---|---|---|---|
| 4,919,162 | A | 4/1990 | Lumby | |
| 5,193,562 | A | 3/1993 | Rigby | |
| 5,934,298 | A | 8/1999 | Singh | |
| 6,092,540 | A | 7/2000 | Chiao | |
| D483,531 | S | 12/2003 | Shelley | |
| 6,814,090 | B2 | 11/2004 | DeBoer | |
| 7,028,697 | B2 | 4/2006 | Christman | |
| 2003/0205246 | A1* | 11/2003 | Christman | ..... A47L 15/4219 134/115 R |

* cited by examiner

*Primary Examiner* — Levon J Shahinian

(57) ABSTRACT

An integrated dishwasher sink apparatus for having a higher loading point and saving cabinet space includes a sink housing configured to be coupled to a countertop of a sink cupboard. A sink basin and a washer basin are coupled to the sink housing. A sliding door is coupled to the sink housing to covers or expose the washer basin. A rack drive is coupled to the washer basin and a motor is in operational communication with the rack drive. A dish rack is coupled to the rack drive to secure a plurality of dishes. A plurality of spray nozzles is coupled to the washer basin and connects to a pressure washer via a plurality of spray tubes. A soap dispenser is coupled to the pressure washer. A control housing is coupled to the sink housing and houses a CPU and a plurality of controls.

12 Claims, 8 Drawing Sheets

INTEGRATED DISHWASHER SINK APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to dishwasher devices and more particularly pertains to a new dishwasher device for having a higher loading point and saving cabinet space. The present invention includes a removable and rotatable multi-tier dish rack, as well as a plurality of spray nozzles extending through a washer bottom side and a washer rear side of a washer basin.

(2) Description of Related Art Including Information Disclosed Under 37 CFR 1.97 and 1.98

The prior art relates to dishwasher devices. Most existing devices are intended to be installed into a standard sink rather than being an integrated device. Known devices are typically limited in height and only offer a single tier rack. These devices also typically lack a compartment to store the lid within the sink cabinet.

BRIEF SUMMARY OF THE INVENTION

An embodiment of the disclosure meets the needs presented above by generally comprising a sink housing configured to be coupled to a countertop of a sink cupboard. A sink basin is coupled to the sink housing. The sink basin has a sink drain aperture extending through a sink bottom side. The sink basin is configured to extend into the sink cupboard. A washer basin is coupled to the sink housing. The washer basin has a washer front side, a washer back side, a washer left side, a washer right side, and a washer bottom side. The washer bottom side has a washer drain aperture extending therethrough. A sliding door is coupled to the sink housing. The sliding door retractably covers or exposes the washer basin. A rack drive is coupled to the washer basin. The rack drive is coupled to an outer face of the washer bottom side and extends through the washer basin. A motor is in operational communication with the rack drive. A dish rack is coupled to the rack drive. The dish rack has a rack base selectively engageable with the rack drive within the washer basin and a plurality of first rack guides coupled perpendicularly to the rack base. The plurality of first rack guides is configured to secure a plurality of dishes. A plurality of spray nozzles is coupled to the washer basin. A plurality of spray tubes is coupled to the spray nozzles. A pressure washer is coupled to the plurality of spray tubes. The pressure washer is configured to be in operational communication with a water supply line. A soap dispenser is coupled to the pressure washer. The soap dispenser is in fluid communication with the pressure washer. A control housing is coupled to the sink housing. A CPU is coupled within the control housing. The CPU is in operational communication with the motor and the pressure washer. A plurality of controls is coupled to the control housing. The plurality of controls is in operational communication with the CPU.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
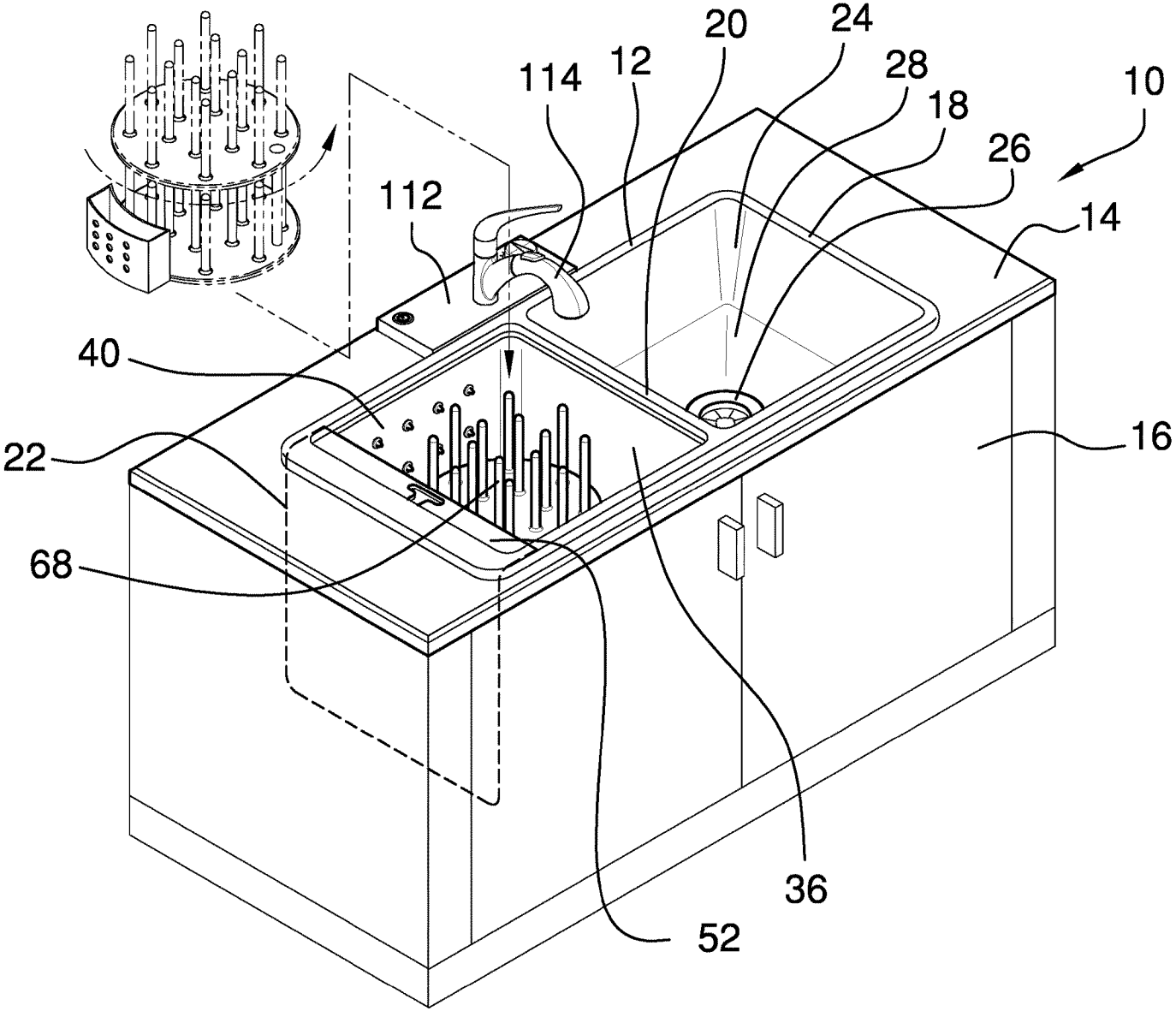
FIG. 1 is an isometric view of an integrated dishwasher sink apparatus according to an embodiment of the disclosure.
Figure 2:
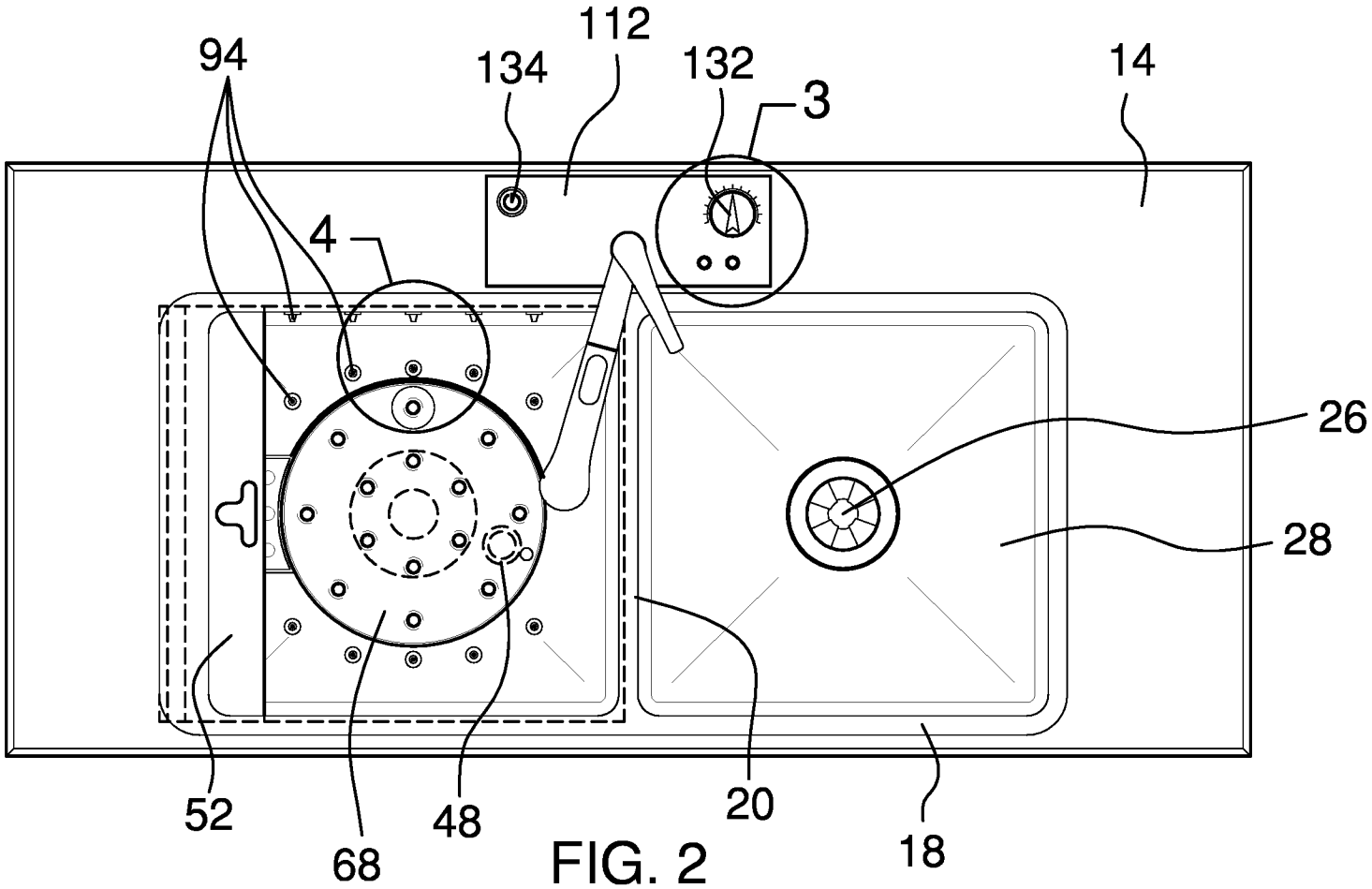
FIG. 2 is a top plan view of an embodiment of the disclosure.
Figure 4:
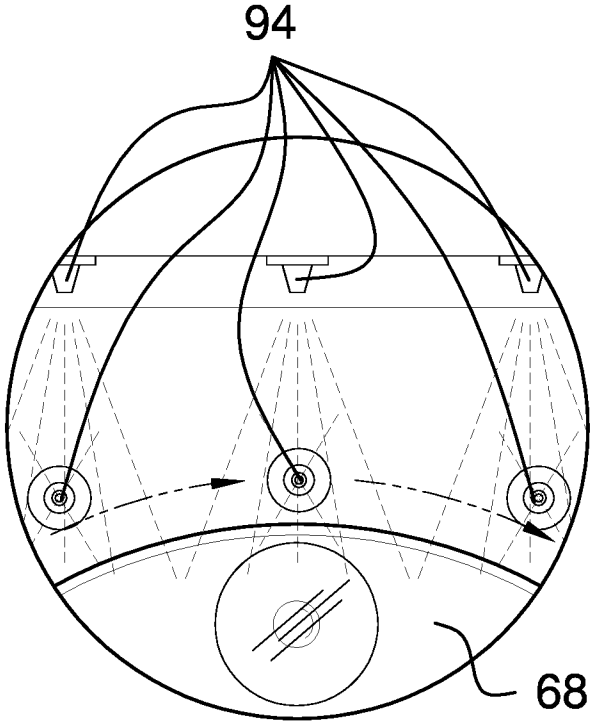
FIG. 4 is a detail view of an embodiment of the disclosure.
Figure 3:
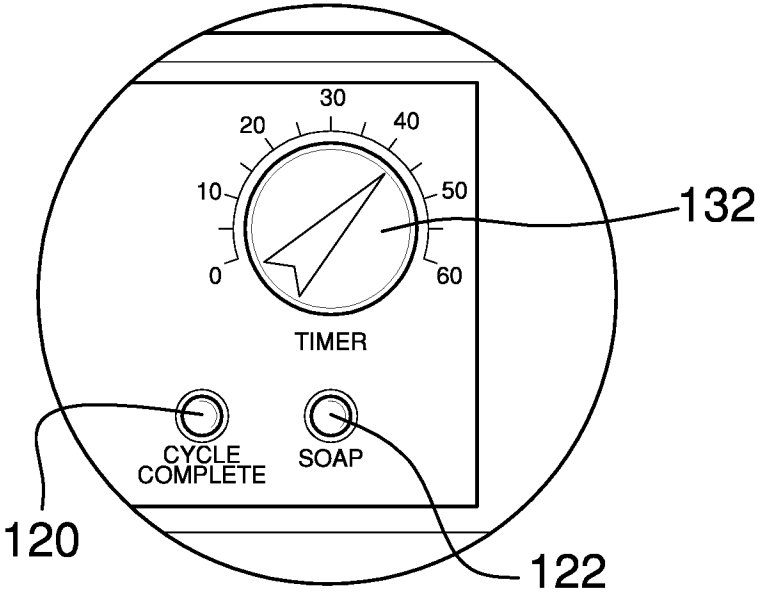
FIG. 3 is a detail view of an embodiment of the disclosure.
Figure 5:
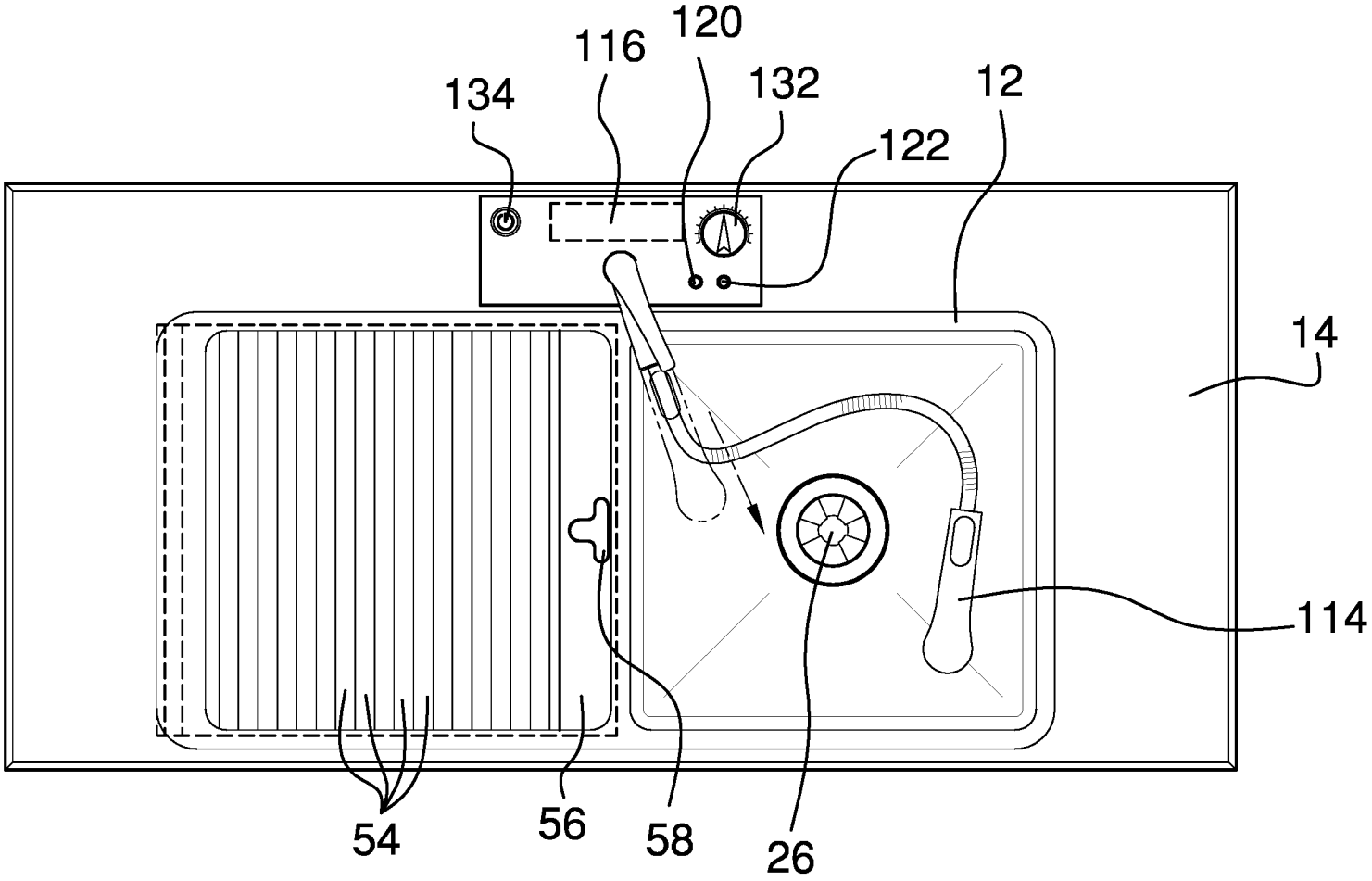
FIG. 5 is a top plan view of an embodiment of the disclosure.
Figure 6:
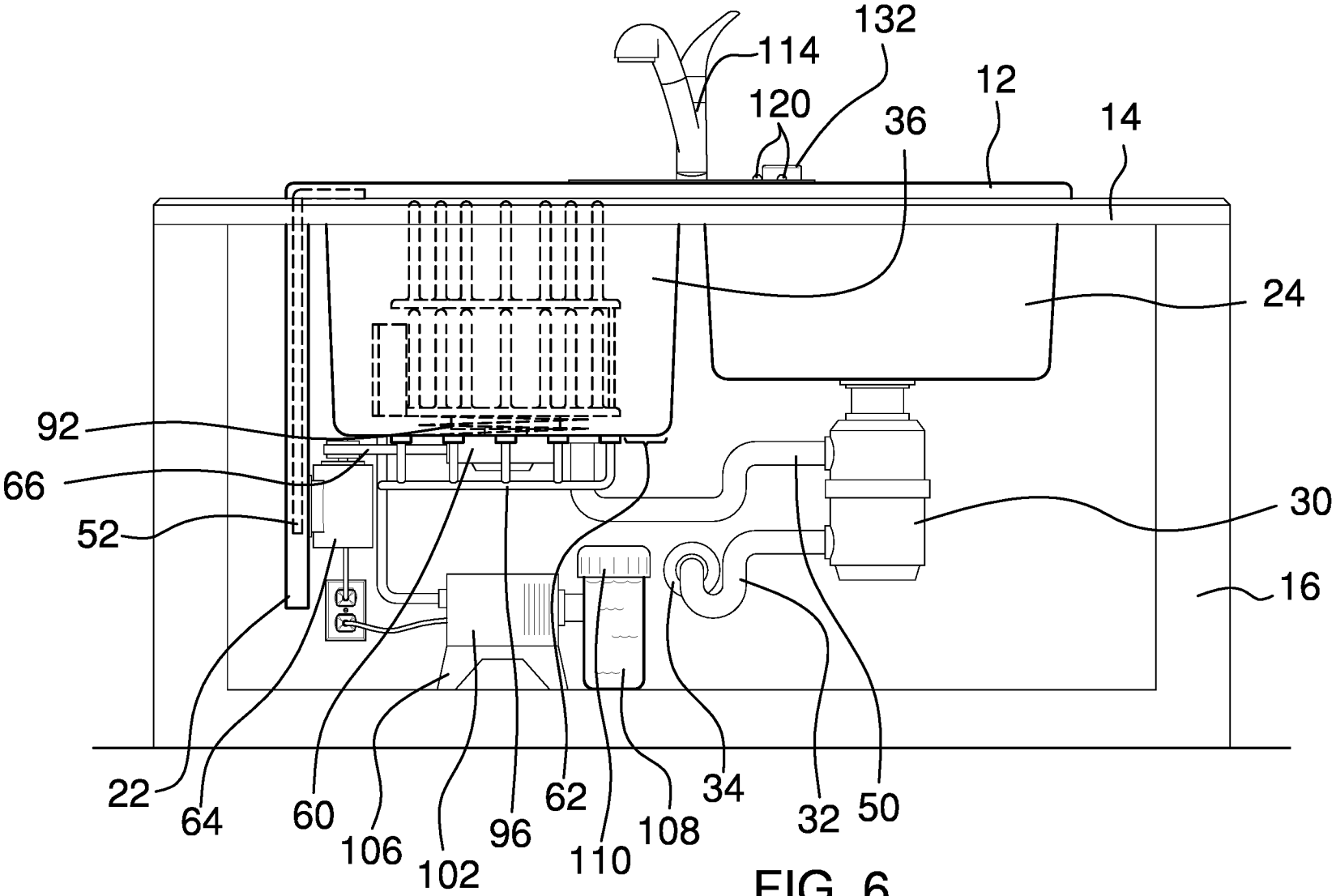
FIG. 6 is a front elevation view of an embodiment of the disclosure.
Figure 7:
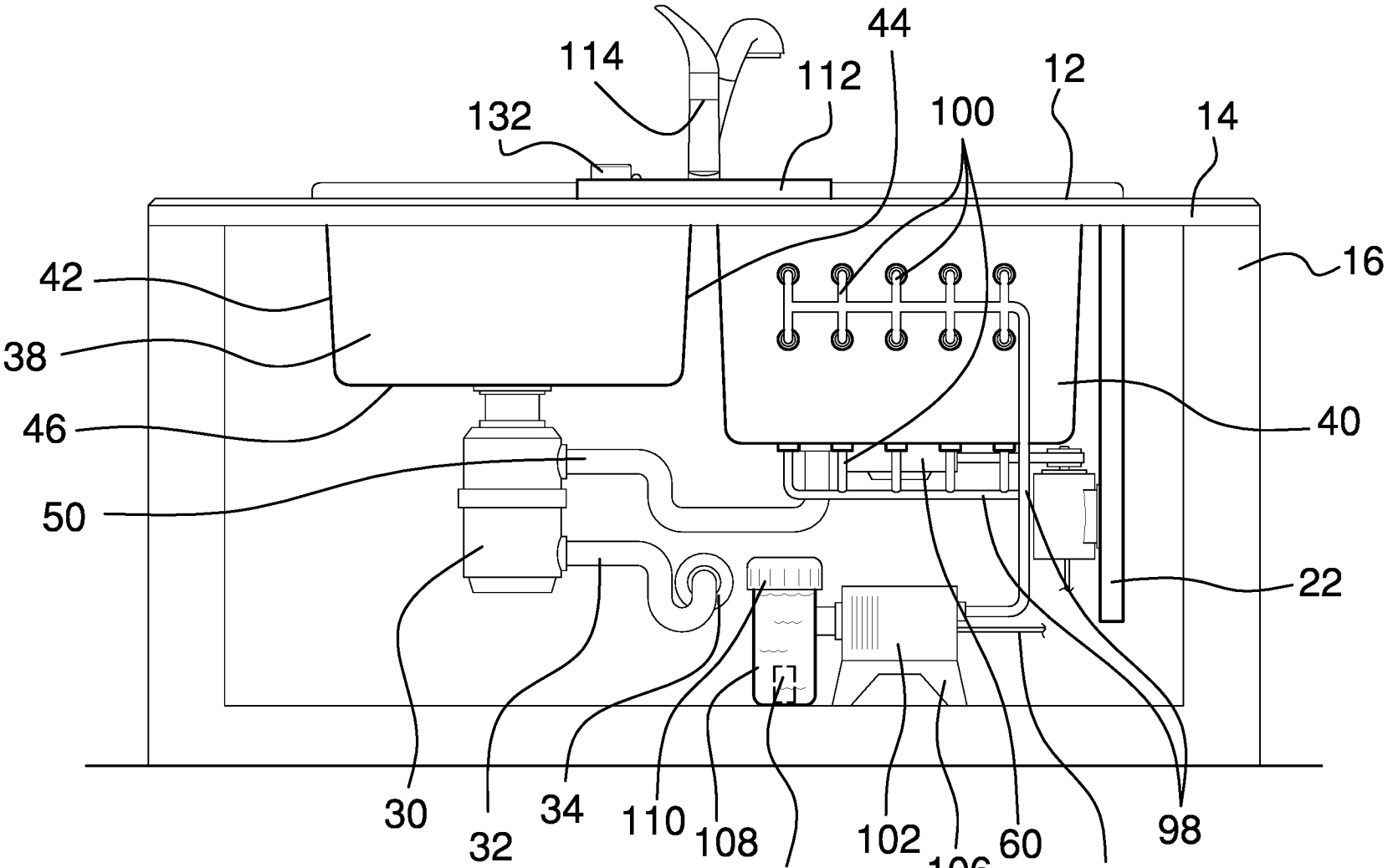
FIG. 7 is a rear elevation view of an embodiment of the disclosure.
Figure 8:
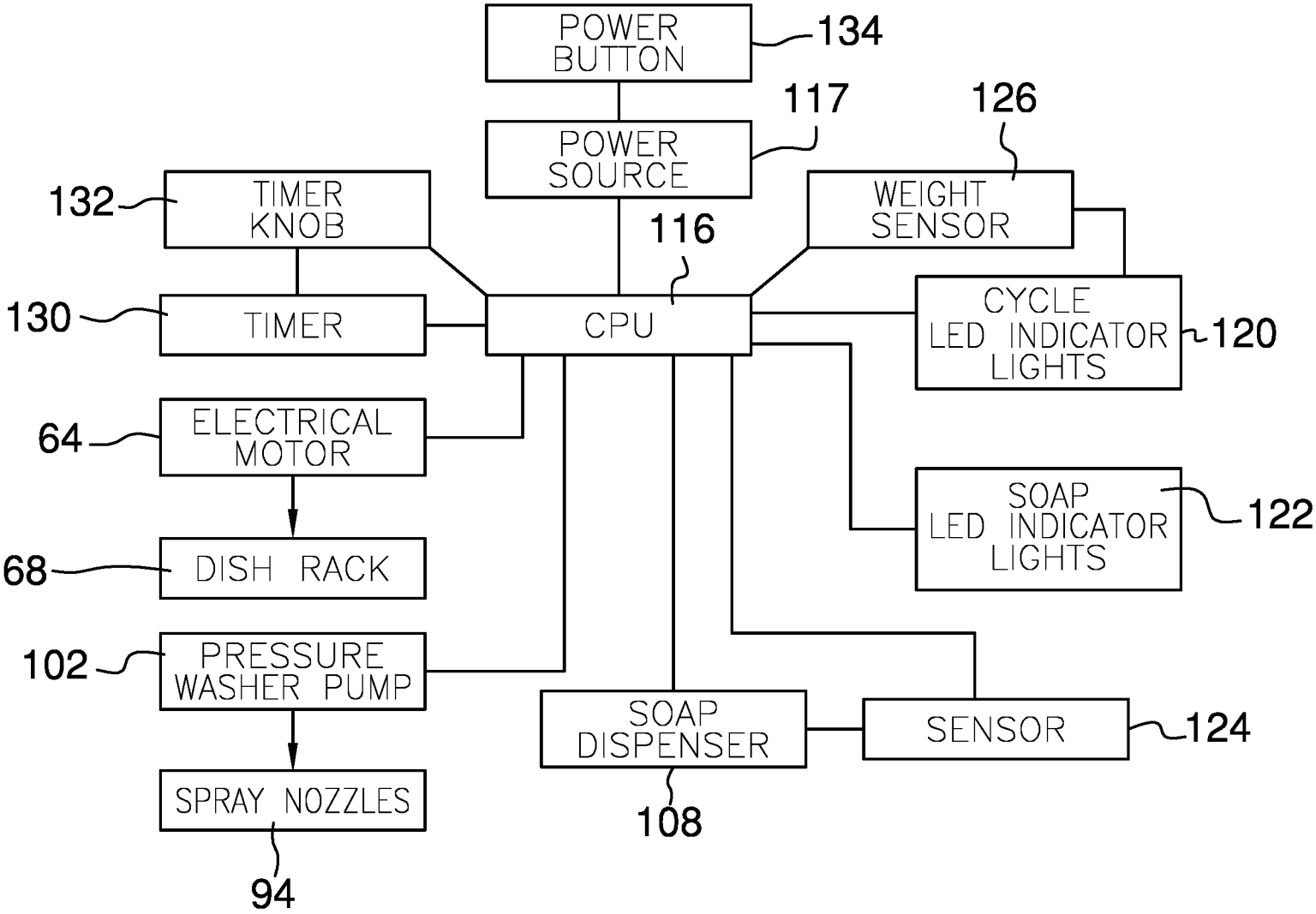
FIG. 8 is block diagram of an embodiment of the disclosure.
Figure 9:
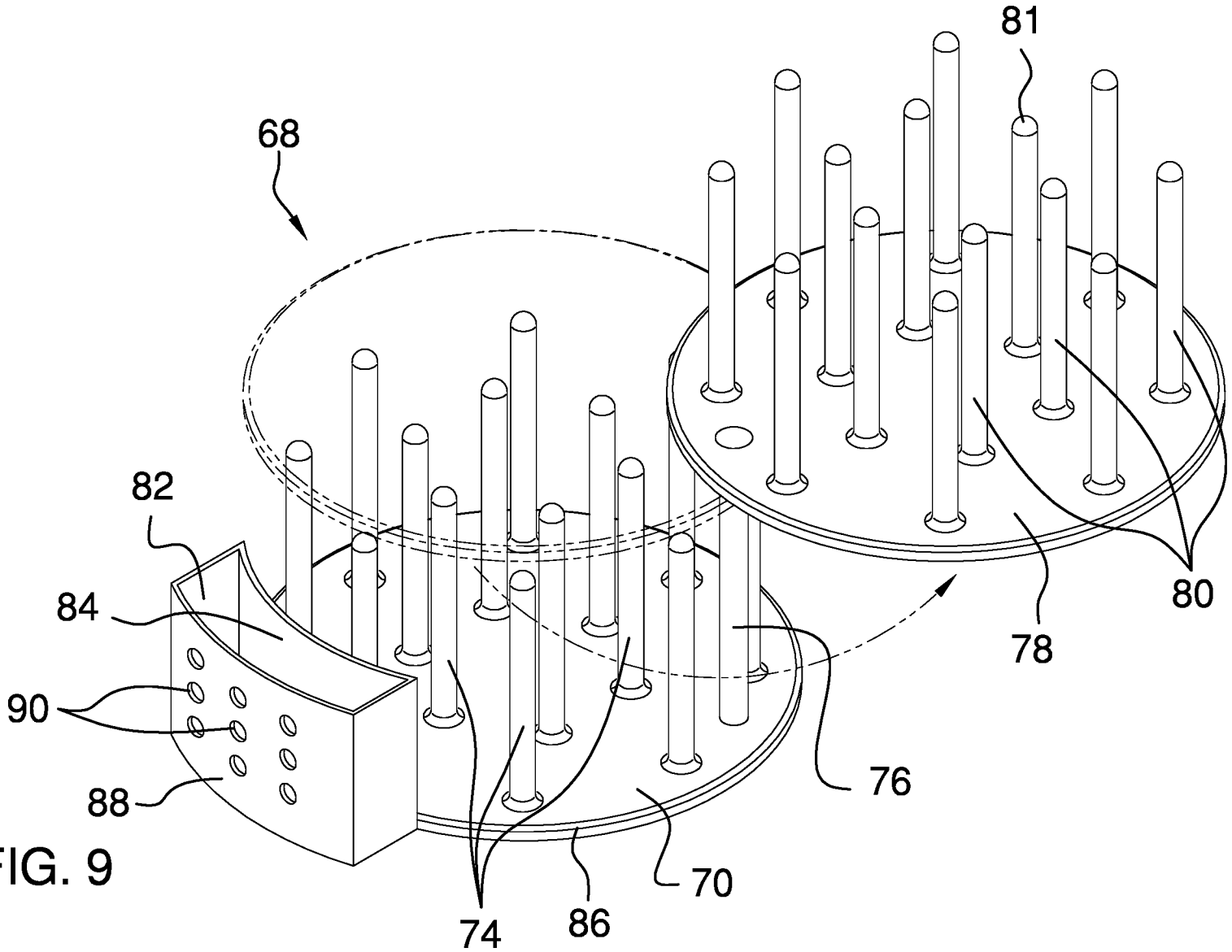
FIG. 9 is an isometric detail view of an embodiment of the disclosure.

With reference now to the drawings, and in particular to FIGS. 1 through 9 thereof, a new dishwasher device embodying the principles and concepts of an embodiment of the disclosure and generally designated by the reference numeral 10 will be described.

As best illustrated in FIGS. 1 through 9, the integrated dishwasher sink apparatus 10 generally comprises a sink housing 12 configured to be coupled to a countertop 14 of a sink cupboard 16. The sink housing 12 may have a housing rim 18 configured to sit atop the countertop 14, a housing divider 20 coupled to the housing rim 18, and a door compartment 22 extending perpendicularly downward from the housing rim 18.

A sink basin 24 is coupled to the sink housing 12. The sink basin 24 has a sink drain aperture 26 extending through a sink bottom side 28. The sink basin 24 is configured to extend into the sink cupboard 16 from the housing rim 18. A garbage disposal 30 may be coupled to the sink drain aperture 26. The garbage disposal 30 may have a p-trap 32 extending to a drain line 34 to prevent odor.

A washer basin 36 is coupled to the sink housing 12. The washer basin 36 has a washer front side 38, a washer back side 40, a washer left side 42, a washer right side 44, and a washer bottom side 46. The washer bottom side 46 has a washer drain aperture 48 extending therethrough. A washer drain pipe 50 extends to the garbage disposal 30. A sliding door 52 is coupled to the sink housing 12 between the housing rim 18 and the washer basin 36. The sliding door 52 retractably covers or exposes the washer basin 36 my moving between a stored position within the door compartment 22 and a use position covering the washer basin 36. The sliding door 52 may include a plurality of articulating panels 54 and a handle leader 56 with a T-shaped handle cutout 58. The handle leader 56 selectively engages the housing divider 20 to create a full waterproof seal over the washer basin 36.

A rack drive 60 is coupled to the washer basin 36. The rack drive 60 is coupled to an outer face 62 of the washer bottom side and extends through the washer basin 36. A motor 64 is in operational communication with the rack drive 60. The motor 64 may be coupled to the door compartment 22 with a pulley 66 extending to the rack drive 60.

A dish rack 68 is coupled to the rack drive 60. The dish rack 68 has a rack base 70 to selectively engage with the rack drive 60 within the washer basin 36 and a plurality of first rack guides 74 coupled perpendicularly to the rack base 70. A shelf support 76 may be coupled to the rack base 70 and extends above the plurality of first rack guides 74. A rack shelf 78 is pivotably coupled to the shelf support 76. The rack shelf 78 conforms to the rack base 70 and moves between a loaded position above the rack base 70 and an unloaded position pivoted to the side of the rack base 70. A plurality of second rack guides 80 is perpendicularly coupled to the rack shelf 78. The plurality of first rack guides 74 and the plurality of second rack guides 80 are configured to secure a plurality of dishes. Each of the first rack guides 74 and the second rack guides 80 may be cylindrical with a hemispherical tip portion 81. Each of the rack base 70 and the rack shelf 78 may be circular.

A utensil holder 82 may be coupled to the dish rack 68. The utensil holder 82 may have a curved inner holder wall 84 coupled to a rack perimeter 86 of the dish rack and a parallel curved outer holder wall 88. The curved outer holder wall 88 has a plurality of drainage apertures 90 extending therethrough to prevent buildup of water. The curvature of each of the inner holder wall 84 and the outer holder wall 88 conforms to the rack base 70.

A rack lift spring 92 may be coupled to the rack drive 60 within the washer basin 36. The rack lift spring 92 is sufficiently strong to lift the dish rack 68 above the washer basin 36 for ease of loading. Once loaded, the dish rack 68 is pushed down to compress the rack lift spring 92 and secured within the washer basin 36.

A plurality of spray nozzles 94 is coupled to the washer basin 36. The plurality of spray nozzles 94 may be coupled to the washer back side 40 and the washer bottom side 46. A plurality of spray tubes 96 is coupled to the spray nozzles 94. The plurality of spray tubes 96 may include a pair of main spray tubes 98 and a plurality of branch spray tubes 100 extending from the pair of main spray tubes 98.

A pressure washer 102 is coupled to the plurality of spray tubes 100. The pressure washer 102 is configured to be in operational communication with a water supply line 104. The pressure washer 102 may include a washer stand 106 to elevate it within the sink cupboard 16. A soap dispenser 108 is coupled to the pressure washer 102. The soap dispenser 108 is in fluid communication with the pressure washer 102. The soap dispenser 108 includes a removable cap 110 for easy refilling.

A control housing 112 is coupled to the sink housing 12. The control housing 112 may extend from the housing rim 18. A retractable faucet 114 may be coupled to the control housing 112 and is in fluid communication with the water supply line 104. A CPU 116 is coupled within the control housing 112 and is in operational communication with the motor 64 and the pressure washer 102. A power source 117 is in operational communication with the CPU 116. A plurality of indicator lights 118 may be coupled to the control housing 112 and in operational communication with the CPU 116. The plurality of indicator lights 118 may include a plurality of cycle lights 120 and a soap light 122. A soap sensor 124 is coupled within the soap dispenser 108 and is in operational communication with the CPU 116 to activate the soap light 122 when the soap dispenser 108 should be refilled.

A weight sensor 126 may be coupled to the rack drive 60. The weight sensor 126 is in operational communication with the CPU 116 to supply an appropriate amount of water and dish soap within the washer basin 36 based on the amount of dishware being cleaned. A plurality of controls 128 is coupled to the control housing 112 and is in operational communication with the CPU 116 to further manipulate settings. The plurality of controls 128 includes a timer 130 having a timer knob 132 for timed cycles and a power button 134 to activate and deactivate the apparatus 10.

In use, dishes are loaded onto the dish rack 68. The sliding door 52 is sealed over the washer basin 36 and the plurality of controls 128 are used to activate the desired cleaning cycle.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An integrated dishwasher sink apparatus comprising:

a sink housing, the sink housing being configured to be coupled to a countertop of a sink cupboard;

a sink basin coupled to the sink housing, the sink basin having a sink drain aperture extending through a sink bottom side, the sink basin being configured to extend into the sink cupboard;

a washer basin coupled to the sink housing, the washer basin having a washer front side, a washer back side, a washer left side, a washer right side, and a washer bottom side, the washer bottom side having a washer drain aperture extending therethrough;

a sliding door coupled to the sink housing, the sliding door retractably covering or exposing the washer basin;

a rack drive coupled to the washer basin, the rack drive being coupled to an outer face of the washer bottom side and extending through the washer basin;

a motor, the motor being in operational communication with the rack drive;

a dish rack coupled to the rack drive, the dish rack having a rack base selectively engageable with the rack drive within the washer basin and a plurality of first rack guides coupled perpendicularly to the rack base, the plurality of first rack guides being configured to secure a plurality of dishes;

a plurality of spray nozzles coupled to the washer basin;

a plurality of spray tubes coupled to the spray nozzles;

a pressure washer coupled to the plurality of spray tubes, the pressure washer being configured to be in operational communication with a water supply line;

a soap dispenser coupled to the pressure washer, the soap dispenser being in fluid communication with the pressure washer;

a control housing coupled to the sink housing;

a CPU coupled within the control housing, the CPU being in operational communication with the motor and the pressure washer; and a plurality of controls coupled to the control housing, the plurality of controls being in operational communication with the CPU.

2. The integrated dishwasher sink apparatus of claim 1 further comprising a shelf support coupled to the rack base, the shelf support extending above the plurality of first rack guides; a rack shelf pivotably coupled to the shelf support, the rack shelf conforming to the rack base, a plurality of second rack guides being perpendicularly coupled to the rack shelf.

3. The integrated dishwasher sink apparatus of claim 2 further comprising each of the rack base and the rack shelf being circular.

4. The integrated dishwasher sink apparatus of claim 1 further comprising a utensil holder coupled to the dish rack.

5. The integrated dishwasher sink apparatus of claim 4 further comprising the utensil holder having a curved inner holder wall coupled to a rack perimeter of the dish rack and a parallel curved outer holder wall, the curved outer holder wall having a plurality of drainage apertures extending therethrough.

6. The integrated dishwasher sink apparatus of claim 1 further comprising a plurality of indicator lights coupled to the control housing, the plurality of indicator lights being in operational communication with the CPU.

7. The integrated dishwasher sink apparatus of claim 6 further comprising the plurality of indicator lights including a plurality of cycle lights and a soap light; a soap sensor being coupled within the soap dispenser, the soap sensor being in operational communication with the CPU.

8. The integrated dishwasher sink apparatus of claim 1 further comprising a weight sensor coupled to the rack drive, the weight sensor being in operational communication with the CPU.

9. The integrated dishwasher sink apparatus of claim 1 further comprising a rack lift spring coupled to the rack drive within the washer basin, the rack lift spring being sufficiently strong to lift the dish rack above the washer basin.

10. The integrated dishwasher sink apparatus of claim 1 further comprising the sink housing having a door compartment extending perpendicularly downward; the sliding door moving between a stored position within the door compartment and a use position covering the washer basin.

11. The integrated dishwasher sink apparatus of claim 10 further comprising the plurality of controls including a timer having a timer knob and a power button.

12. An integrated dishwasher sink apparatus comprising:

a sink housing, the sink housing being configured to be coupled to a countertop of a sink cupboard, the sink housing having a door compartment extending perpendicularly downward;

a sink basin coupled to the sink housing, the sink basin having a sink drain aperture extending through a sink bottom side, the sink basin being configured to extend into the sink cupboard;

a washer basin coupled to the sink housing, the washer basin having a washer front side, a washer back side, a washer left side, a washer right side, and a washer bottom side, the washer bottom side having a washer drain aperture extending therethrough;

a sliding door coupled to the sink housing, the sliding door retractably covering or exposing the washer basin, the sliding door moving between a stored position within the door compartment and a use position covering the washer basin;

a rack drive coupled to the washer basin, the rack drive being coupled to an outer face of the washer bottom side and extending through the washer basin;

a motor, the motor being in operational communication with the rack drive;

a dish rack coupled to the rack drive, the dish rack having a rack base selectively engageable with the rack drive within the washer basin and a plurality of first rack guides coupled perpendicularly to the rack base, a shelf support coupled to the rack base, the shelf support extending above the plurality of first rack guides;

a rack shelf pivotably coupled to the shelf support, the rack shelf conforming to the rack base, a plurality of second rack guides being perpendicularly coupled to the rack shelf, the plurality of first rack guides and the plurality of second rack guides being configured to secure a plurality of dishes, each of the rack base and the rack shelf being circular;

a utensil holder coupled to the dish rack, the utensil holder having a curved inner holder wall coupled to a rack perimeter of the dish rack and a parallel curved outer holder wall, the curved outer holder wall having a plurality of drainage apertures extending therethrough;

a rack lift spring coupled to the rack drive within the washer basin, the rack lift spring being sufficiently strong to lift the dish rack above the washer basin;

a plurality of spray nozzles coupled to the washer basin;

a plurality of spray tubes coupled to the spray nozzles;

a pressure washer coupled to the plurality of spray tubes, the pressure washer being configured to be in operational communication with a water supply line;

a soap dispenser coupled to the pressure washer, the soap dispenser being in fluid communication with the pressure washer;

a control housing coupled to the sink housing;

a CPU coupled within the control housing, the CPU being in operational communication with the motor and the pressure washer;

a plurality of indicator lights coupled to the control housing, the plurality of indicator lights being in operational communication with the CPU, the plurality of indicator lights including a plurality of cycle lights and a soap light;

a soap sensor being coupled within the soap dispenser, the soap sensor being in operational communication with the CPU;

a weight sensor coupled to the rack drive, the weight sensor being in operational communication with the CPU; and a plurality of controls coupled to the control housing, the plurality of controls being in operational communication with the CPU, the plurality of controls including a timer having a timer knob and a power button.

* * * * *